US011686005B1

(12) United States Patent
Roh et al.

(10) Patent No.: US 11,686,005 B1
(45) Date of Patent: Jun. 27, 2023

(54) ELECTROPLATING SYSTEMS AND METHODS WITH INCREASED METAL ION CONCENTRATIONS

(71) Applicant: Applied Materials, Inc., Santa Clara, CA (US)

(72) Inventors: Kwan Wook Roh, Kalispell, MT (US); Charles Sharbono, Whitefish, MT (US); Kyle M. Hanson, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/587,063

(22) Filed: Jan. 28, 2022

(51) Int. Cl.

| | |
|---|---|
| ***C25D 3/38*** | (2006.01) |
| ***C25D 7/12*** | (2006.01) |
| ***C25D 21/14*** | (2006.01) |
| ***C25D 17/00*** | (2006.01) |

(52) U.S. Cl.
CPC ..... *C25D 3/38* (2013.01); *C25D 7/12* (2013.01); *C25D 17/001* (2013.01); *C25D 17/002* (2013.01); *C25D 21/14* (2013.01)

(58) Field of Classification Search
CPC ..... C25D 7/12–123; C25D 17/001; C25D 17/002; H01L 21/2885; H01L 21/76873; H01L 2224/11462
See application file for complete search history.

(56) References Cited

U.S. PATENT DOCUMENTS

| | | | | |
|---|---|---|---|---|
| 8,128,791 | B1 * | 3/2012 | Buckalew ..... | C25D 17/002 205/101 |
| 2004/0245113 | A1 | 12/2004 | Bokisa, Sr. et al. | |
| 2010/0075174 | A1 | 3/2010 | Bohnet et al. | |
| 2016/0312373 | A1 | 10/2016 | Mayer et al. | |

FOREIGN PATENT DOCUMENTS

| | | | |
|---|---|---|---|
| JP | 2009185383 | A | 8/2009 |
| KR | 102179205 | B1 | 11/2020 |

OTHER PUBLICATIONS

Areej, Basics of on/off Controller, accessed at https://automationforum.co/basics-off-controller/ (Year: 2018).*
Pan et al., Original & Machine Translation, CN 113604846 A (Year: 2021).*
Application No. PCT/US2022/046899, International Search Report and Written Opinion, dated Feb. 14, 2023, 11 pages.

* cited by examiner

*Primary Examiner* — Hosung Chung
(74) *Attorney, Agent, or Firm* — Kilpatrick Townsend & Stockton LLP

(57) ABSTRACT

Electroplating methods and systems are described that include adding a metal-ion-containing starting solution to a catholyte to increase a metal ion concentration in the catholyte to a first metal ion concentration. The methods and systems further include measuring the metal ion concentration in the catholyte while the metal ions electroplate onto a substrate and the catholyte reaches a second metal ion concentration that is less than the first metal ion concentra- (Continued)

tion. The methods and systems additionally include adding a portion of an anolyte directly to the catholyte when the catholyte reaches the second metal ion concentration. The addition of the portion of the anolyte increases the metal ion concentration in the catholyte to a third metal ion concentration that is greater than or about the first metal ion concentration.

13 Claims, 8 Drawing Sheets

ELECTROPLATING SYSTEMS AND METHODS WITH INCREASED METAL ION CONCENTRATIONS

TECHNICAL FIELD

The present technology relates to electroplating operations in semiconductor processing. More specifically, the present technology relates to systems and methods that perform concentration and replenishment for electroplating systems.

BACKGROUND

Integrated circuits are made possible by processes which produce intricately patterned material layers on substrate surfaces. After formation, etching, and other processing on a substrate, metal or other conductive materials are often deposited or formed to provide the electrical connections between components. Because this metallization may be performed after many manufacturing operations, problems occurring during the metallization may create expensive waste substrates or wafers.

Electroplating is performed in an electroplating chamber with the device side of the wafer in a bath of liquid electrolyte, and with electrical contacts on a contact ring touching a conductive layer on the wafer surface. Electrical current is passed through the electrolyte and the conductive layer. Metal ions in the electrolyte plate out onto the wafer, creating a metal layer on the wafer. Electroplating chambers typically have consumable anodes, which are beneficial for bath stability and cost of ownership. For example, it is common to use copper consumable anodes when plating copper. The copper ions taken out of the plating bath are replenished by the copper removed from the anodes, thereby maintaining the metal concentration in the plating bath. Although effective at replacing plated metal ions, using consumable anodes requires a relatively complex and costly design to allow the consumable anodes to be replaced. Even more complexity is added when consumable anodes are combined with a membrane to avoid degrading the electrolyte, or oxidizing the consumable anodes during idle state operation.

Thus, there is a need for improved systems and methods that can be used to produce high quality devices and structures while protecting both the substrate and the plating baths. These and other needs are addressed by the present technology.

SUMMARY

Embodiments of the present technology include electroplating methods that include adding a metal-ion-containing starting solution to a catholyte to increase a metal ion concentration in the catholyte to a first metal ion concentration. The methods further include measuring the metal ion concentration in the catholyte while the metal ions electroplate onto a substrate and the catholyte reaches a second metal ion concentration that is less than the first metal ion concentration. The methods additional include adding a portion of an anolyte directly to the catholyte when the catholyte reaches the second metal ion concentration. The addition of the portion of the anolyte increases the metal ion concentration in the catholyte to a third metal ion concentration that is greater than or about the first metal ion concentration.

In additional embodiments, the method further includes measuring a catholyte pH in the catholyte and an anolyte pH in the anolyte. In further embodiments, the method includes adding a second portion of the anolyte directly to the catholyte when the catholyte pH is less than or about 2. In still further embodiments, the method further includes adding a second portion of the anolyte directly to the catholyte when the difference between the anolyte pH and the catholyte pH is greater than or about 0.2. In yet additional embodiments, the third metal ion concentration in the catholyte is greater than the metal ion concentration in the metal-ion-containing starting solution. In more embodiments, the second metal ion concentration in the catholyte is less than or about 55 g/L. In still more embodiments, the third metal ion concentration in the catholyte is greater than or about 70 g/L. In yet more embodiments, the metal ion is selected from the group consisting of copper ions, tin ions, and nickel ions.

Embodiments of the present technology also include electroplating methods which include electroplating a metal on a substrate in contact with a catholyte that includes electroplatable metal ions and an acid. The methods also include measuring a catholyte pH in the catholyte and an anolyte pH in an anolyte that is separated from the catholyte by a selective ion membrane. The methods further include adding a portion of the anolyte directly to the catholyte when a difference in pH between the anolyte pH and the catholyte pH is greater than or about 0.2.

In additional embodiments, the methods further include adding the portion of the anolyte directly to the catholyte when the catholyte pH is less than or about 2. In further embodiments, the catholyte includes an inorganic acid selected from the group consisting of sulfuric acid, hydrochloric acid, and nitric acid. In still further embodiments, the methods further includes adding a metal-ion-containing starting solution to the catholyte to increase a metal ion concentration in the catholyte to a first metal ion concentration. The methods also include measuring the metal ion concentration while the metal is electroplating on the substrate until the metal ion concentration reaches a second metal ion concentration that is less than the first metal ion concentration. The methods yet also include adding an additional portion of the anolyte directly to the catholyte when the catholyte reaches the second metal ion concentration, where the addition of the additional portion of the anolyte increases the metal ion concentration to a third metal ion concentration that is greater than or about the first metal ion concentration. In more embodiments, the second metal ion concentration is less than or about 55 g/L and the third metal ion concentration is greater than or about 70 g/L. In still more embodiments, the metal electroplated on the substrate is selected from the group consisting of copper, tin, and nickel.

Embodiments of the present technology further include electroplating systems that include a first compartment operable to house a catholyte and a second compartment operable to house an anolyte. The first and second compartments are separated by an ion selective membrane. The systems also include a sensor in the first compartment operable to measure at least one of a catholyte pH and a catholyte metal ion concentration. The systems further include a conduit between the first compartment and the second compartment operable to transport a portion of the anolyte to the catholyte without passing the portion of the anolyte through the ion selective membrane.

In additional embodiments, the conduit passes the portion of the anolyte to the catholyte when the sensor in the first compartment measures the catholyte metal ion concentration at less than or about 70 g/L. In further embodiments, the conduit passes the portion of the anolyte to the catholyte when the sensor in the first compartment measures the catholyte pH at less than or about 2. In still further embodiments, the system further includes a second sensor in the second compartment operable to measure at least one of an anolyte pH and an anolyte metal ion concentration. In more embodiments, the conduit passes the portion of the anolyte to the catholyte when the sensor in the first compartment and the second sensor in the second compartment measure a pH difference of greater than or about 0.2. In still more embodiments, the catholyte and the anolyte include a metal ion selected from the group consisting of copper ions, tin ions, and nickel ions.

Such technology may provide numerous benefits over conventional technology. For example, the present technology may create and maintain electroplating operations a high metal ion concentrations that increase the rates at which metals are electroplated onto substrates. Additionally, the present technology may can reduce the amount of metal-ion-containing starting solution needed to increase the metal ion concentration in the catholyte of the electroplating bath. These and other embodiments, along with many of their advantages and features, are described in more detail in conjunction with the below description and attached figures.

BRIEF DESCRIPTION OF THE DRAWINGS

A further understanding of the nature and advantages of the disclosed embodiments may be realized by reference to the remaining portions of the specification and the drawings.

Figure 1:
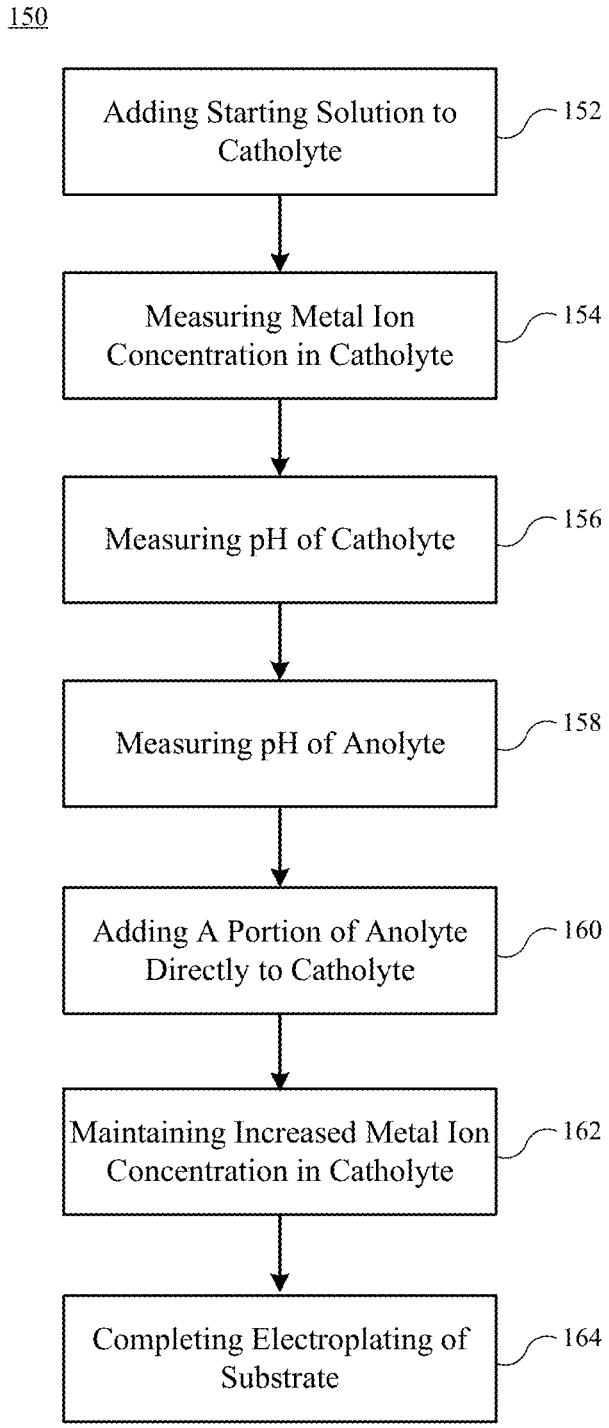
FIG. 1 shows exemplary operations in a method of operating an electroplating system according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

The metal deposition rate for many electroplated metals increases with higher concentrations of the metal ion in aqueous solution. Conventional techniques to increase the metal ion concentration of an aqueous electroplating solution include adding more starting liquid to the electroplating solution and evaporating some of the water from the solution. Unfortunately, each of these techniques create problems for electroplating systems that use anolyte and catholyte solutions separated by an ion selective membrane that passes metal ions from the anolyte to the catholyte where metal plating on a substrate surface occurs.

In electroplating systems that include both an anolyte and catholyte solution, the increase in metal ion concentration normally targets the catholyte because of its direct contact with the electroplating surfaces of the substrate. For most starting liquids, the added metal ions also come with added acid that keeps the metal ions from precipitating out of the starting liquid. The added acid in the catholyte can reduce the rate at which metal ions from the anolyte are transported across the ion selective membrane to the catholyte. As the difference in the acidity between catholyte and anolyte increases, the rate of metal ion transport from anolyte to catholyte can be reduced by 50% or more.

The ion selective membrane itself can also contribute to the acidity imbalance by favoring the transport of acidic hydrogen ions over metal ions from anolyte to catholyte. Over time, the ion selective membrane creates a less acidic anolyte that is more concentrated in metal ions and a more acidic catholyte that is less concentrated in metal ions. The imbalance in metal ion concentration between anolyte and catholyte gets larger during electroplating operations as the increasing difference in the acidity between the anolyte and catholyte further slows the transport of metal ion from anolyte to catholyte.

Embodiments of the present technology address these problems by supplying some of the less-acidic, more metal-ion-concentrated anolyte solution to the more-acidic, less metal-ion-concentrated catholyte solution during electroplating operations. In embodiments, the anolyte solution is supplied by bypassing the ion selective membrane to add the anolyte directly to the catholyte. This has the effect of increasing the metal ion concentration in the catholyte while also decreasing catholyte acidity. In additional embodiments, it reduces the amount of added starting liquid, and/or water evaporation, needed to increase the metal ion concentration in the catholyte. In further embodiments, it permits electroplating operations at metal ion concentrations that are higher those found in the starting liquid.

Figure 2:
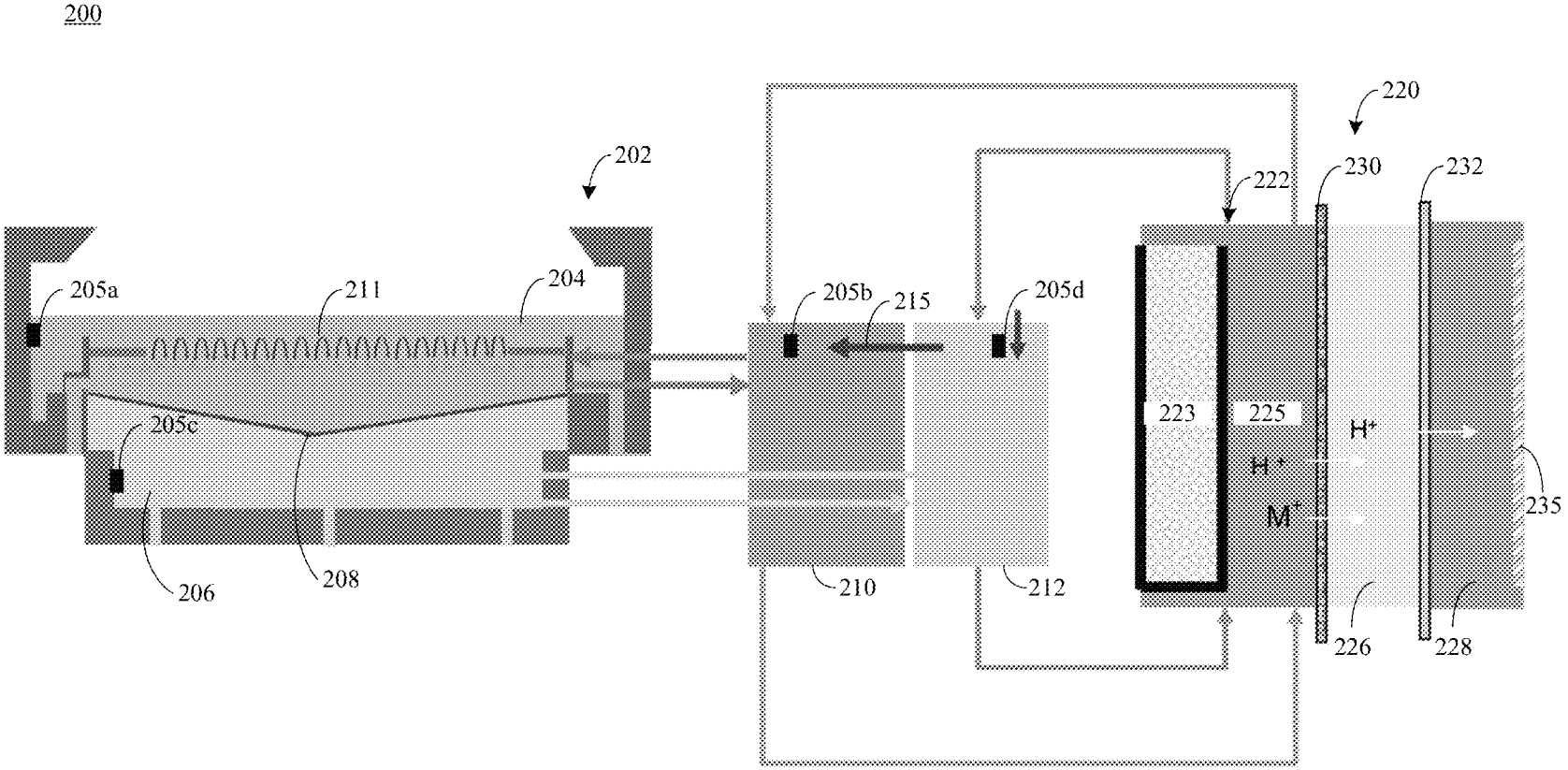
FIG. 2 shows a schematic view of an electroplating processing system according to some embodiments of the present technology.

FIG. 1 shows exemplary operations in a method 150 of operating an electroplating system according to some embodiments of the present technology. The method may be performed in a variety of processing systems characterized by an anolyte bypass mechanism, including the electroplating systems according to embodiments of the present technology described below, which include exemplary electroplating system 200 shown in FIG. 2. For illustration purposes, exemplary operations of method 150 will be described in conjunction with the relevant components of electroplating system 200. It will be appreciated that method 150 may also include one or more optional operations, which may or may not be specifically associated with some embodiments of methods according to the present technology. It will also be appreciated that any of the electroplating systems operated according to method 150 may also include one or more the additional components or features discussed throughout the present disclosure.

Method 150 includes adding a metal-ion-containing starting solution to a catholyte at operation 152. In system 200, the starting metal-ion-containing starting solution may be added directly to the catholyte 204 in electroplating chamber 202 and/or directly to the catholyte in catholyte reservoir 210. In embodiments, the addition of the metal-ion-containing starting solution may adjust the metal ion concentration to a first metal ion concentration that is substantially the same as the metal ion concentration in the metal-ion-containing starting solution. In further embodiments, the first metal ion concentration may be less than or about 60 g/L, less than or about 55 g/L, less than or about 50 g/L, or less.

In some embodiments, the system 200 may be substantially drained of catholyte prior to the addition of the metal-ion-containing starting solution and the addition represents the filling or refilling of the system's catholyte at the beginning of an electroplating method. In these embodiments, the first metal ion concentration in the catholyte 204 is the metal ion concentration of the starting solution. In additional embodiments, the metal-ion-containing starting solution may be added to system 200 that already contains catholyte. In these embodiments, the addition operation 152 adjusts the first metal ion concentration in catholyte 204 or catholyte reservoir 210 closer to the metal ion concentration in the metal-ion-containing starting solution. Depending on the metal ion concentration of the preexisting catholyte in system 200, the addition operation 152 may increase or decrease the metal ion concentration to reach the first metal ion concentration.

Method 150 further includes measuring the metal ion concentration in the catholyte 204 at operation 154. In embodiments, the metal ion concentration may be measured by a metal ion sensor 205*a* positioned in the electroplating chamber 202 to be in fluid contact with the catholyte 204. During the portion of an electroplating operation when the metal ions are plating on the substrate, the metal ion concentration in catholyte 204 drops. The magnitude of the drop depends on a number of factors, including the electroplated surface area of the substrate (or substrates), the volume of catholyte, the amount of electric current passing through the electrodes of system 200, and the rate of metal ion transport between the anolyte and catholyte, among other factors. The rate of metal ion transport is further influenced by a number of factors including the absolute and relative metal ion concentration in the catholyte and anolyte, as well as the acidity (pH) of the catholyte and anolyte as well as the difference in acidity between the catholyte and anolyte.

In embodiments, the measurement of the metal ion concentration in catholyte 204 may be continuous, or may be done at intervals before, during, and after the electroplating of metal onto a substrate. In further embodiments, the measurement of the metal ion concentration in the catholyte 204 may measure a reduction in the metal ion concentration from the first metal ion concentration immediately following the addition of the metal-ion-containing starting solution at operation 152 to a second metal ion concentration that is less than the first metal ion concentration. In additional embodiments, when the measurement operation 154 finds the metal ion concentration has decreased to the second metal ion concentration or lower, a signal may be sent from sensor 205*a* to increase the metal ion concentration in the catholyte 204.

It should be appreciated that metal ion concentration measurements can be taken at locations in system 200 other than the catholyte 204 in the electroplating chamber 202. In embodiments, the metal ion concentration may be measured in the catholyte held in catholyte reservoir 210 by a metal ion sensor 205*b* in contact with the catholyte. In some electroplating operations, the measurement of the metal ion concentration in the catholyte held in the catholyte reservoir 210 may be less variable than measurements of the metal ion concentration in the catholyte 204 held in the electroplating chamber 202. In other electroplating operations, changes in the metal ion concentration may be measured more rapidly in the catholyte 204 than the catholyte held in catholyte reservoir 210. In further embodiments, metal ion measurements may be made in both the catholyte 204 held in the electroplating chamber 202 and the catholyte reservoir 210.

Method 150 may also include measuring the pH of the catholyte 204 at operation 156. In embodiments, the pH may be measured by sensor 205*a* that is also capable of measuring the metal ion concentration in the catholyte 204. In further embodiments, the pH may be measured by a sensor (not shown) that is independent of sensor 205*a*, such as a dedicated pH meter. In more embodiments, the catholyte pH measured at operation 156 may further include generating a pH signal from the pH sensor that is in electronic communication with a logic processor (not shown). When the sensor indicates that the catholyte pH is at or below a threshold level, the logic processor may generate a signal to perform one or more operations to increase the catholyte pH. As discussed below, these operations may include directly adding less acidic anolyte to the more acidic catholyte. In yet more embodiments, the catholyte pH that causes the logic processor to generate the signal to start the one or more pH increasing operations may be less than or about 2.5, less than or about 2.4, less than or about 2.3, less than or about 2.2, less than or about 2.1, less than or about 2.0, less than or about 1.9, less than or about 1.8, less than or about 1.7, less than or about 1.6, less than or about 1.5, or less.

Method 200 may further include measuring the pH of the anolyte at operation 158. In system 200, the anolyte pH may be measured by one or more sensors 205*c* and 205*d* in contact with the anolyte 206 in the electroplating chamber 202, and the anolyte in anolyte reservoir 212, respectively. In these embodiments, a further operation may compare the anolyte pH to the catholyte pH to determine a difference in pH between the anolyte and catholyte. In embodiments, a difference in pH that exceeds a difference threshold may cause a signal to be generated by the pH sensors or a logic processor that receives pH measurement information from the pH sensors. In additional embodiments, the signal may instruct system 200 to perform a pH rebalancing operation that decreases the difference in pH between the anolyte and catholyte. More about these rebalancing operations is discussed below. In yet additional embodiments, the difference threshold between the pH of the anolyte and catholyte that causes a pH rebalancing signal to be generated may be greater than or about 0.1, greater than or about 0.2, greater than or about 0.3, greater than or about 0.4, greater than or about 0.5, or more. For example, if the pH of the anolyte 206 exceeds the pH of the more acidic catholyte 204 by greater than or about 0.1, greater than or about 0.2, greater than or about 0.3, greater than or about 0.4, greater than or about 0.5, or more, a pH rebalancing signal will be generated.

Method 150 further includes adding a portion of the anolyte directly to the catholyte at operation 160. In embodiments, operation 160 may increase the metal ion concentration in the catholyte. In further embodiments, operation 160 may increase the catholyte pH and/or reduce a difference in the pH between the catholyte and the anolyte. Referring to system 200, operation 160 may include transporting a portion of the anolyte in anolyte reservoir 212 directly to the catholyte is catholyte reservoir 210 through conduit 215. The catholyte in catholyte reservoir 210 supplies an enhanced catholyte to catholyte 204 in the electroplating chamber 202 that is characterized by an increased metal ion concentration and/or increased pH (i.e., lower acidity). In embodiments, the catholyte 204 may be characterized by a metal ion concentration of greater than or about 55 g/L, greater than or about 60 g/L, greater than or about 65 g/L, greater than or about 70 g/L, greater than or about 75 g/L, or more following the addition of a portion of the anolyte directly to the catholyte. In further embodiments, the pH of catholyte 204 may be characterized as greater than or about 2.1, greater than or about 2.2, greater than or about 2.3, greater than or about 2.4, greater than or about 2.5, greater than or about 2.6, greater than or about 2.7, greater than or about 2.8, greater than or about 2.9, greater than or about 3, greater than or about 3.25, greater than or about 3.5, greater than or about 3.75, greater than or about 4, or more, following the addition of a portion of the anolyte directly to the catholyte.

It should be appreciated that there are additional configurations (not shown in FIG. 2) to add a portion of the anolyte directly to the catholyte in operation 160. In additional embodiments, a conduit (not shown) may transport a portion of the anolyte in anolyte reservoir 212 directly to the catholyte 204 in electroplating chamber 202. In more embodiments, a conduit (not shown) that bypasses the selective ion membrane 208 in electroplating chamber 202 may transport a portion of the anolyte 206 directly to the catholyte 204 in the electroplating chamber. In still more embodiments, operation 160 may be characterized as adding anolyte directly to catholyte without passing the transported anolyte through a membrane that separates anolyte and catholyte.

In embodiments, the anolyte directly added to the catholyte in operation 160 rebalances the metal ion concentration and acidity of the anolyte and catholyte as they get increasingly unbalanced during electroplating. As noted above, electroplating involves the removal of metal ions from the catholyte in fluid contact with the substrate as the ions are reduced to a metal layer on the substrate. The removal of the electroplated metal ions from the catholyte causes the metal ion concentration in the catholyte to decrease. In electroplating systems according to embodiments of the present technology, like system 200, the metal ions in the catholyte are replenished in large part by the migration of metal ions from the anolyte 206 though an ion selective membrane 208 that selectively passes the metal ions while blocking the migration of other components of the anolyte and catholyte. In embodiments, these other components can include catholyte additives such as suppressors (e.g., polyethylene glycols), accelerators (e.g., bis-(3-sulfopropyl)-disulfide), and levelers (e.g., Janus Green B dye) that facilitate the electroplating of a uniform metal layer on the substrate. The selective ion membrane prevents the additives from traversing the membrane with the metal ions and, for example, forming a film on an electrode with opposite charge (e.g., negatively-charged additives forming a film on the anode).

In many embodiments, the migration of metal ions through the ion selective membrane 208 is slower than the migration of hydrogen ions (W) through the membrane. Over time, the replenishment of electroplating metal ions in the catholyte 204 with metal ions in the anolyte 206 increases a concentration gradient between the catholyte and anolyte. It also increases a pH gradient as the catholyte becomes more acidic due to the migration of fast-moving hydrogen ions from anolyte to catholyte. The imbalance in the metal ion concentration and pH between the anolyte and catholyte can decrease the rate at which the metal ions electroplate onto the substrate for several reasons. Among them, the decreased metal ion concentration in the catholyte 204 slows the rate at which the metal ions are transported from the catholyte to the surface of the substrate. Another reason is that the increased hydrogen ion concentration in the increasingly acidified catholyte 204 slows the rate at which the metal ions migrate through the ion selective membrane 208. The addition of a portion of the metal-ion-rich and hydrogen-ion-poor anolyte to the metal-ion-poor and hydrogen-ion-rich catholyte reverses these natural trends during electroplating and maintains or increases the electroplating rate of the metal on the substrate. This reversal may be accomplished without adding additional metal-ion-containing starting solution to the catholyte 204 or using conventional methods to concentrate the metal ions in the catholyte, such as heating the catholyte to evaporate water.

Method 150 may further include maintaining an increased metal ion concentration in the catholyte at operation 162. As noted above, this operation may include migrating metal ions from the anolyte 206 to the catholyte 204 through the ion selective membrane 208. In further embodiments, this operation includes more additions of a portion of the anolyte directly to the catholyte. In embodiments, these further additions may occur when the measured metal ion concentration in the catholyte drop to or below a threshold metal ion concentration. In more embodiments, that threshold metal ion concentration may be less than or about 75 g/L, less than or about 70 g/L, less than or about 65 g/L, less than or about 60 g/L, less than or about 55 g/L, less than or about 50 g/L, or less. In additional embodiments, operation 162 may include a periodic addition of the anolyte directly to the catholyte during the electroplating of the metal on the substrate. In still additional embodiments, the anolyte may be added directly to the catholyte at intervals of greater than or about 1 minute, greater than or about 2 minutes, greater than or about 3 minutes, greater than or about 4 minutes, greater than or about 5 minutes, greater than or about 6 minutes, greater than or about 7 minutes, greater than or about 8 minutes, greater than or about 9 minutes, greater than or about 10 minutes, or more.

In additional embodiments, the catholyte 204 may be stirred or otherwise agitated to facilitate the transport of the metal ions from the catholyte to the substrate surface and maintain a uniform concentration of metal ions in the catholyte that contacts the substrate surface. In further embodiments, system 200 may further include a stirring unit 211 to stir the catholyte 204 in the electroplating chamber 202 during an electroplating operation.

Method 150 may still further include the completion of the electroplating of the metal on the substrate at operation 164. In embodiments, the completion operation 164 may include the removal of the substrate from contact with the catholyte 204 in the electroplating chamber 202. In further embodiments, a single substrate may be in contact with the catholyte 204 in the electroplating chamber 202. In still further embodiments, two or more substrates may, at the same time, be in contact with the catholyte 204 in the electroplating chamber 202. In yet further embodiments, the electroplating chamber 202 may be operable to hold at least two substrates, at least three substrates, at least five substrates, at least ten substrates, at least fifteen substrates, at least twenty substrates, or more.

In additional embodiments, method 150 may include one or more of the measuring operations 154, 156, and 158. In some embodiments, method 150 may include measuring the metal ion concentration in the catholyte 204 (i.e., operation 154) but not also measuring the pH of the catholyte (i.e., operation 156) or the pH of the anolyte 206 (i.e., operation 158). In other embodiments, method 150 may include measuring the pH of the catholyte 204 but not measuring its metal ion concentration or the pH of the anolyte 206. In still other embodiments, method 150 may include measuring the pH of the catholyte 204 and the anolyte 206, but not the metal ion concentration of the catholyte.

In further embodiments, the metal ions refer to the metal ions capable of being electroplated as a metal on a substrate that is in fluid contact with the catholyte. It should be appreciated that the metal-ion-containing starting solution, catholyte, and anolyte, may include other metal ions (e.g., ions of alkali metals and alkaline earth metals) that are not counted in the metal ion concentration because they are not electroplated as metals on the substrate. In additional embodiments, the metal ions may include copper ions, tin ions, and nickel ions, among other types of metal ions. These metal ions are electroplated as metal layers of copper, tin, and nickel, respectively, on the surface of the substrate. In further embodiments, the metal ions may be dissolved ions of a metal salt that is at least partially soluble in water. In embodiments, these metal salts may include copper sulfate ($CuSO_4$) and copper chloride ($CuCl_2$) among other metal salts.

In still further embodiments, the catholyte and anolyte may be aqueous solutions or mixtures that include the metal ions. In embodiments, the catholyte may include, in addition to the metal ions, one or more additives such as a suppressor, an accelerator, and a leveler, among other additives. In further embodiments, the anolyte may lack at least one additive found in the catholyte. This makes the direct addition of a portion of the anolyte to the catholyte to increase the catholyte's metal ion concentration more cost effective than the addition of catholyte starting solution that includes the additives. The present technology provides for an increase in the catholyte's metal ion concentration to levels that are even higher than those in the metal-ion-containing catholyte starting solution without unduly concentrating the catholyte in additives that are also present in the metal-ion-containing starting solution.

In embodiments, electroplating system 200 may include additional components that facilitate electroplating operations. In additional embodiments, electroplating system 200 may include a replenishing assembly 220 that provides additional metal ions to the anolyte and catholyte during electroplating operations. In further embodiments, the replenishing assembly 220 may include a metal ion generation chamber 222, an isolyte chamber 226, and a third chamber 228 in contact with a cathode electrode 235. In more embodiments, the metal ion generation chamber 222 and the isolyte chamber 226 may be fluidly separated by a first ion selective membrane 230 that is operable to pass both metal ions and hydrogen ions from the metal ion generation chamber to the isolyte chamber. In additional embodiments, the first ion selective membrane 230 may slow or block the transfer of additives between the metal ion generation chamber 222 and the isolyte chamber 226. In still more embodiments, the isolyte chamber 226 and the third chamber 228 may be fluidly separated by a second ion selective membrane 232 that is operable to pass hydrogen ions from the isolyte chamber to the third chamber. In yet more embodiments, the second ion selective membrane 232 may slow or block the migration of metal ions and additives from the isolyte chamber 226 to the third chamber 228.

In embodiments, the anolyte chamber 222 may include a first compartment 223 to hold anode material that generates additional metal ions for the anolyte contained in a second compartment 225 that is in fluid contact with the anode material. In more embodiments, the anode material in first compartment 223 may also act as an anode that is electrically connected to a cathode that is in fluid contact with the catholyte in the catholyte chamber 228. In still more embodiments, a portion of the metal ions generated by the anode material may be added to the catholyte in the catholyte reservoir 210 and/or the anolyte in the anolyte reservoir 212. The additional metal ions help maintain the concentration of metal ions in the catholyte and the anolyte in the electroplating chamber 202 and reservoirs 210 and 212 during electroplating operations.

Figure 3:
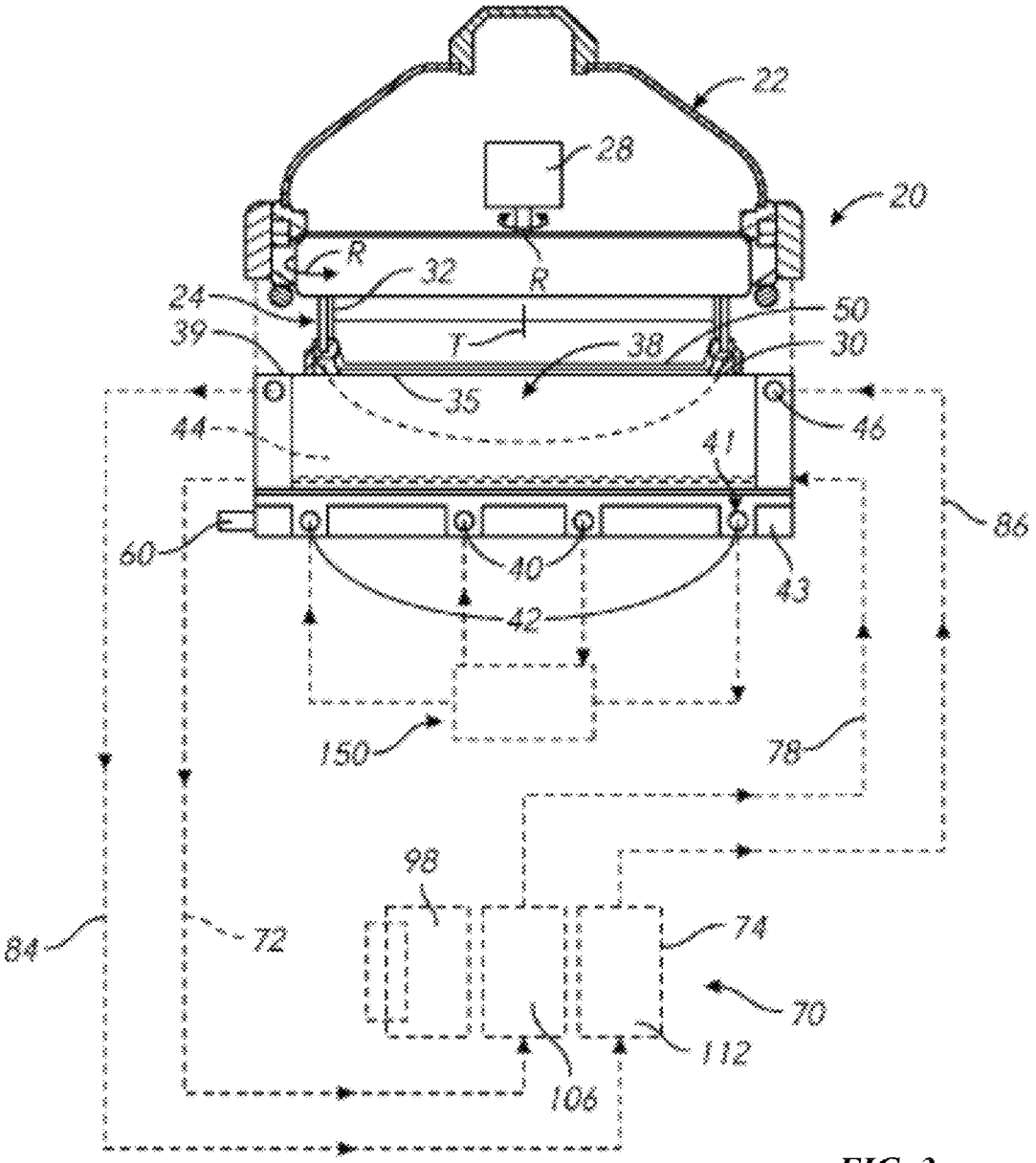
FIG. 3 shows a schematic view of an electroplating processing system according to some embodiments of the present technology.

FIG. 3 shows a schematic view of another electroplating processing system according to some embodiments of the present technology. In FIG. 3, an electroplating chamber 20 may include a rotor 24 in a head 22 for holding a wafer 50. The rotor 24 may include a contact ring 30 which may move vertically to engage contact fingers 35 on the contact ring 30 onto the down facing surface of a wafer 50. The contact fingers 35 may be connected to a negative voltage source during electroplating. A bellows 32 may be used to seal internal components of the head 22. A motor 28 in the head may rotate the wafer 50 held in the contact ring 30 during electroplating. The chamber 20 may alternatively have various other types of head 22. For example, the head 22 may operate with a wafer 50 held in a chuck rather than handling the wafer 50 directly, or the rotor and motor may be omitted with the wafer held stationery during electroplating. A seal on the contact ring may seal against the wafer to seal the contact fingers 35 away from the catholyte during processing. The head 22 may be positioned over an electroplating vessel 38 of the electroplating chamber 20. One or more inert anodes may be provided in the vessel 38. In the example shown, the electroplating chamber 20 may include an inner anode 40 and an outer anode 42. Multiple electroplating chambers 20 may be provided in columns within an electroplating system, with one or more robots moving wafers in the system.

Figure 4:
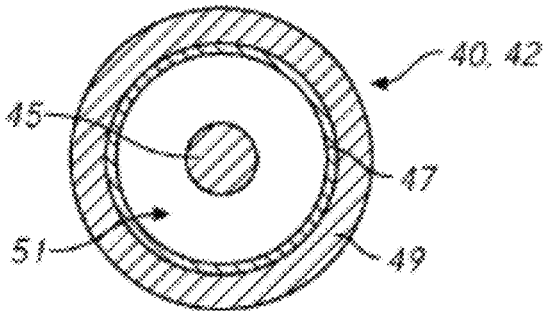
FIG. 4 shows a cross-sectional view of an inert anode according to some embodiments of the present technology.

FIG. 4 shows a cross-sectional view of an inert anode according to some embodiments of the present technology. In FIG. 4 the anodes 40 and 42 may include a wire 45 within a membrane tube 47. The membrane tube 47 may have an outer protective sleeve or covering 49. The membrane tube 47, including the electrode wire, may be circular, or optionally formed into a spiral, or linear arrays, or take another form appropriate to create the electric field adapted for the workpiece being processed. In some embodiments, the wire 45 may be up to a 2 mm diameter platinum wire within a 2-3 mm inside diameter membrane tube 47. The wire 45 may also be a platinum clad wire with an interior core of another metal such as niobium, nickel, or copper. A resistive diffuser may be provided in the vessel above the inert anodes. A flow space 51 may be provided around the wire 45 within the membrane tube 47. Although the wire 45 may be nominally centered within the membrane tube 47, in practice the position of the wire within the membrane tube can vary, to the extent that the wire may be touching the inside wall of the membrane tube, at some locations. Spacers may be used to maintain the wire within the tube, although no spacers or other techniques to center the wire within the membrane tube may be needed.

Additionally illustrated in FIG. 3 is a three-compartment replenish assembly 70, which will be described in further detail below. During electroplating, process anolyte may be pumped through a process anolyte loop that includes the anode membrane tubes 47 and a process anolyte chamber 150 which is a process anolyte source to the anodes 40 and 42. The membrane tubes forming the anodes 40 and 42 may be formed into a ring or circle, contained within a circular slot 41 in an anode plate 43 of the vessel 38, as shown with the membrane tubes resting on the floor of the vessel 38. The replenishing system 70 may be external to the chamber 20 in that it is a separate unit which may be located remote from the processor, within a processing system. This may allow a replenish assembly to be fluidly coupled with multiple electroplating chambers, where the replenish assembly by replenish catholyte used by any number of chambers.

The wire 45 of each anode 40, 42 may be electrically connected to a positive voltage source relative to the voltage applied to the wafer to create an electric field within the vessel. Each of the inert anodes may be connected to one electrical power supply channel, or they may be connected to separate electrical power supply channels, via an electrical connector 60 on the vessel 38. One to four inert anodes may typically be used. The anolyte flow through the membrane tubes may carry the gas out of the vessel. In use, the voltage source may induce an electric current flow causing conversion of water at the inert anode into oxygen gas and hydrogen ions and the deposition of copper ions from the catholyte onto the wafer. The wire 45 in the anodes 40 and 42 may be inert and may not react chemically with the anolyte. The wafer 50, or a conductive seed layer on the wafer 50, may be connected to a negative voltage source. During electroplating, the electric field within the vessel 38 may cause metal ions in the catholyte to deposit onto the wafer 50, creating a metal layer on the wafer 50.

The metal layer plated onto the wafer 50 may be formed from metal ions in the chamber catholyte which move to the wafer surface due to chamber catholyte flow and ion diffusion in the vessel 38. A catholyte replenishing system 70 may be fluidly coupled with the electroplating chamber to supply metal ions back into the system catholyte. The replenishing system 70 may include a chamber catholyte return line, which may be or include a tube or pipe, and a chamber catholyte supply line 78 connecting a replenish assembly 74 in a catholyte circulation loop. In some embodiments, an additional catholyte tank may be included in the catholyte circulation loop, with the chamber catholyte tank supplying catholyte to multiple electroplating chambers 20 within a processing system. The catholyte circulation loop may include at least one pump, and may also include other components such as heaters, filters, valves, and any other fluid loop or circulation components. The replenish assembly 74 may be in line with the catholyte return, or it may alternatively be connected in a separate flow loop out of and back to the catholyte tank.

Figure 5:
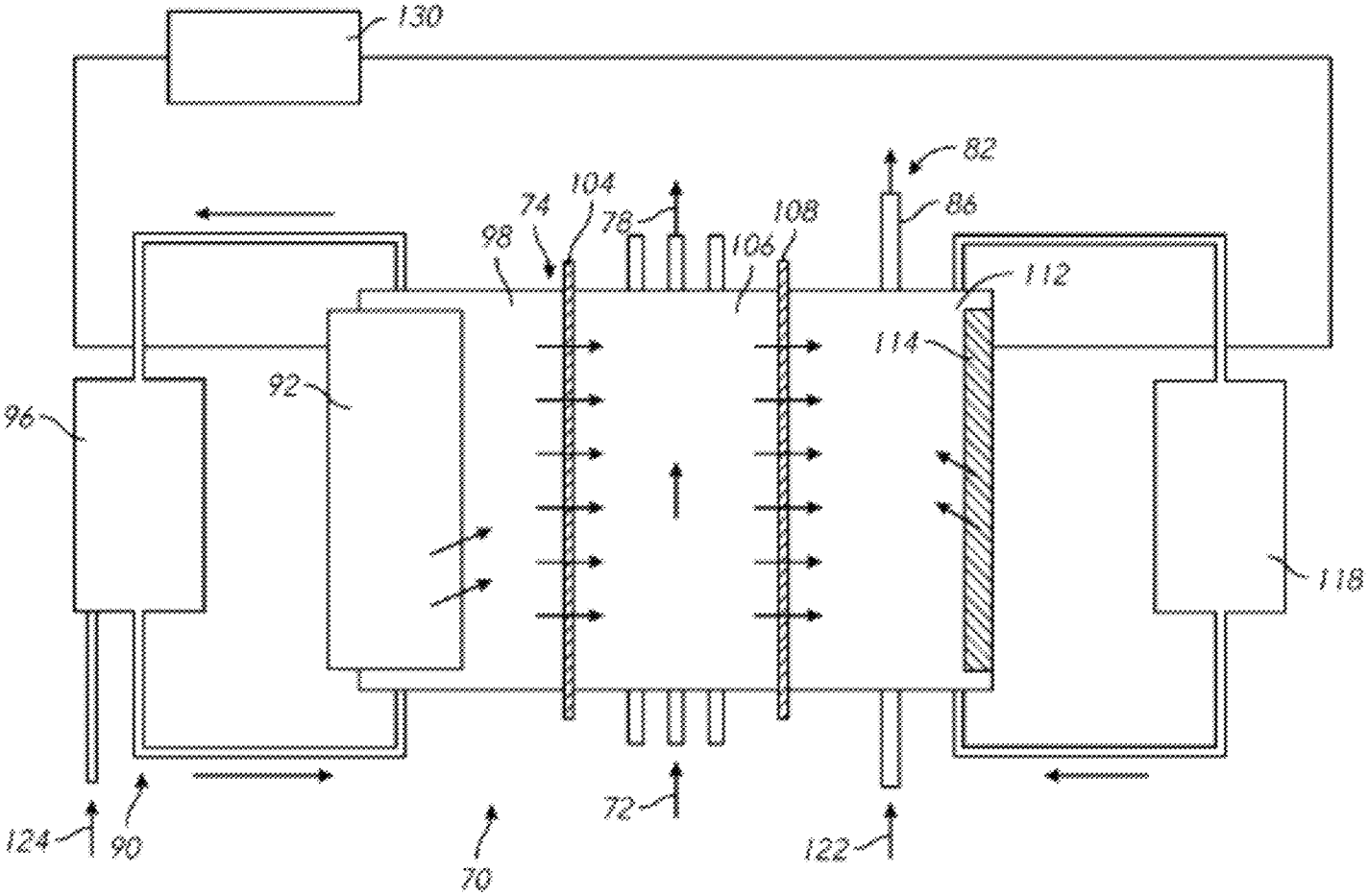
FIG. 5 shows a schematic view of a replenish assembly according to some embodiments of the present technology.

FIG. 5 shows a schematic view of a replenish assembly according to some embodiments of the present technology, and may provide details of replenish assemblies described further below. The figure shows an enlarged schematic view of the replenish assembly 74 as operational components that may be applicable to any number of specific replenish assembly configurations, including those described further below. A replenish assembly anolyte may circulate within the replenish assembly 74 through a replenish assembly anolyte loop 90 including a replenish assembly anolyte compartment 98, which may be a first compartment of the replenish assembly, and optionally a replenish assembly anolyte tank 96. In some embodiments, such as for copper plating, the replenish assembly anolyte may be a copper sulfate electrolyte with no acid, although it is to be understood that the system may be used for any number of electroplating operations utilizing chemistries and materials suitable for those operations. The anolyte replenish assembly within the replenish assembly 74 may not require a recirculation loop and may include just an anolyte compartment 98. A gas sparger, for example a nitrogen gas sparger, can provide agitation for the replenish assembly without the complication of a recirculation loop requiring plumbing and a pump. Again referring to a copper plating system, as a non-limiting example, if a low acid electrolyte or anolyte is used, when current is passed across the replenish assembly, $Cu^{2+}$ ions may transport or move across the membrane into the catholyte, rather than protons. Gas sparging may also reduce oxidation of bulk copper material.

A de-ionized water supply line 124 may supply make-up de-ionized water into the replenish assembly anolyte tank 96 or the compartment 98. Bulk plating material 92, such as copper pellets for example, may be provided in the replenish assembly anolyte compartment 98 and provide the material which may be plated onto the wafer 50. A pump may circulate replenish assembly anolyte through the replenish assembly anolyte compartment 98. The replenish assembly anolyte may be entirely separate from the anolyte provided to the anodes 40 and/or 42. Additionally, in some embodiments, an anolyte compartment 98 may be used without any replenish assembly anolyte loop 90. A gas sparger, for example, or some other pumping system can provide agitation for the anolyte compartment 98 without using a replenish assembly anolyte loop. For example, some embodiments of anolyte compartments, or first compartments, may include an anolyte replenish tank, or may simply circulate anolyte within the compartment, or within two sections of the compartment as will be described further below.

Within the replenish assembly 74, a first cation membrane 104 may be positioned between the replenish assembly anolyte in the replenish assembly anolyte compartment 98 and catholyte in a catholyte compartment 106, to separate the replenish assembly anolyte from the catholyte. The catholyte return line 72 may be connected to one side of the catholyte compartment 106 and the catholyte supply line 78 may be connected to the other side of the catholyte compartment 106, which may allow circulation of catholyte from the vessel 38 through the catholyte chamber. Alternately, the catholyte flow loop through the replenish assembly 74 may be a separate flow circuit with the catholyte tank. The first cation membrane 104 may allow metal ions and water to pass through the replenish assembly anolyte compartment 98 into the catholyte in the catholyte chamber, while otherwise providing a barrier between the replenish assembly anolyte and the catholyte. Deionized water may added to the catholyte to replenish water lost to evaporation, but more commonly water evaporation can be enhanced to evaporate the water entering into the catholyte through electro-osmosis from the anolyte replenish assembly. An evaporator may also be included to facilitate removal of excess water.

The flow of metal ions into the catholyte may replenish the concentration of metal ions in the catholyte. In embodiments, as metal ions in the catholyte are deposited onto the wafer 50 to form the metal layer on the wafer 50, they may be replaced with metal ions originating from the bulk plating material 92 moving through the replenish assembly anolyte and the first membrane 104 into the catholyte flowing through the catholyte compartment 106 of the replenish assembly 74. In further embodiments, metal ions are added to the catholyte by directly transporting a portion of the anolyte to the catholyte through a conduit that bypasses the ion membranes.

An inert cathode 114 may be located in the thiefolyte compartment 112 opposite from the second cation membrane 108. The negative or cathode of a power supply 130, such as a DC power supply, may be electrically connected to the inert cathode 114. The positive or anode of the power supply 130 may be electrically connected to the bulk plating material 92 or metal in the replenish assembly anolyte compartment 98 applying or creating a voltage differential across the replenish assembly 74. Replenish assembly electrolyte in the thiefolyte compartment 112 may optionally circulate through a replenish assembly tank 118, with deionized water and sulfuric acid added to the replenish assembly electrolyte via an inlet 122. The thiefolyte compartment 112 electrolyte may include, for example, deionized water with 1-10% sulfuric acid. The inert cathode 114 may be a platinum or platinum-clad wire or plate. The second ionic membrane 108 may help to retain copper ions in the second compartment. Additionally, the second ionic membrane 108 may be configured to particularly maintain $Cu^{2+}$ within the catholyte. For example, in some embodiments, the second ionic membrane may be a monovalent membrane, which may further limit passage of copper through the membrane.

Referring back to FIGS. 3 and 4, the chamber 20 may optionally include an electric current thief electrode 46 in the vessel 38, although in some embodiments no electric current thief may be included. In some embodiments, the electric current thief electrode 46 may also have an electric current thief wire within an electric current thief membrane tube, similar to the anode 40 or 42 described above. If a thief electrode is used, reconditioning electrolyte may be pumped through the electric current thief membrane tube. The electric current thief wire may be generally connected to a negative voltage source which is controlled independently of the negative voltage source connected to the wafer 50 via the contact ring 30. The electric current thief membrane tube may be connected to a thiefolyte compartment 112 in the replenish assembly 74 via a replenish assembly circulation loop, generally indicated at 82, via a replenish assembly electrolyte return line 84 and a replenish assembly electrolyte supply line 86. If used, the high acid catholyte bath in catholyte compartment 106 may ensure that a high portion of the current crossing membrane 108 may be protons rather than metal ions. In this way, the current within the replenish assembly 74 may replenish the copper within the catholyte while preventing it from being lost through the membrane.

A second cation membrane 108 may be positioned between the catholyte in the catholyte compartment 106 and the replenish assembly electrolyte in the thiefolyte compartment 112. The second cation membrane 108 may allow protons to pass through from the catholyte in the catholyte compartment 106 into the replenish assembly electrolyte in the thiefolyte compartment 112, while limiting the amount of metal ions that pass through the membrane, which may then plate out on the inert cathode. The primary function of thiefolyte compartment 112 is to complete the electrical circuit for the replenish assembly chamber in a way that does not plate metal out onto the inert cathode 114. The thiefolyte compartment 112 may be used with or without an extra tank or circulation loop. The high acid electrolyte or catholyte bath in catholyte compartment 106 may ensure that a high portion of the current crossing membrane 108 is protons rather than metal ions, so that the cathode reaction on the inert cathode 114 is mostly hydrogen evolution. In this way, the current within the replenish assembly 74 replenishes the copper within the catholyte while preventing it from being lost through membrane 108.

During idle state operation, when the replenish assembly is not in use, the replenishing system 70 stops the flow of catholyte over the bulk plating material 92 which forms the consumable anode. In some embodiments, the thiefolyte may be drained from the thiefolyte compartment during idle state to limit additional loss of metal ions, additives, or other bath constituents from the catholyte due to diffusion, or other transport mechanisms, of metal ions across membrane 108. However, as explained above, challenges may exist both by leaving catholyte and anolyte within the respective compartments, as well as draining the two materials. Draining the catholyte may facilitate air entrainment on startup, which may detrimentally impact plating. Draining the anolyte may expose the anode material leading to oxidation. However, leaving the two electrolytes within the respective chambers may allow a gradient occurring between the materials across the membrane to cause additives to be lost from the catholyte. Accordingly, some embodiments of the present technology may incorporate an additional divider that may be utilized to separate the anolyte and catholyte within their respective compartments during idle state operation.

Figure 6:
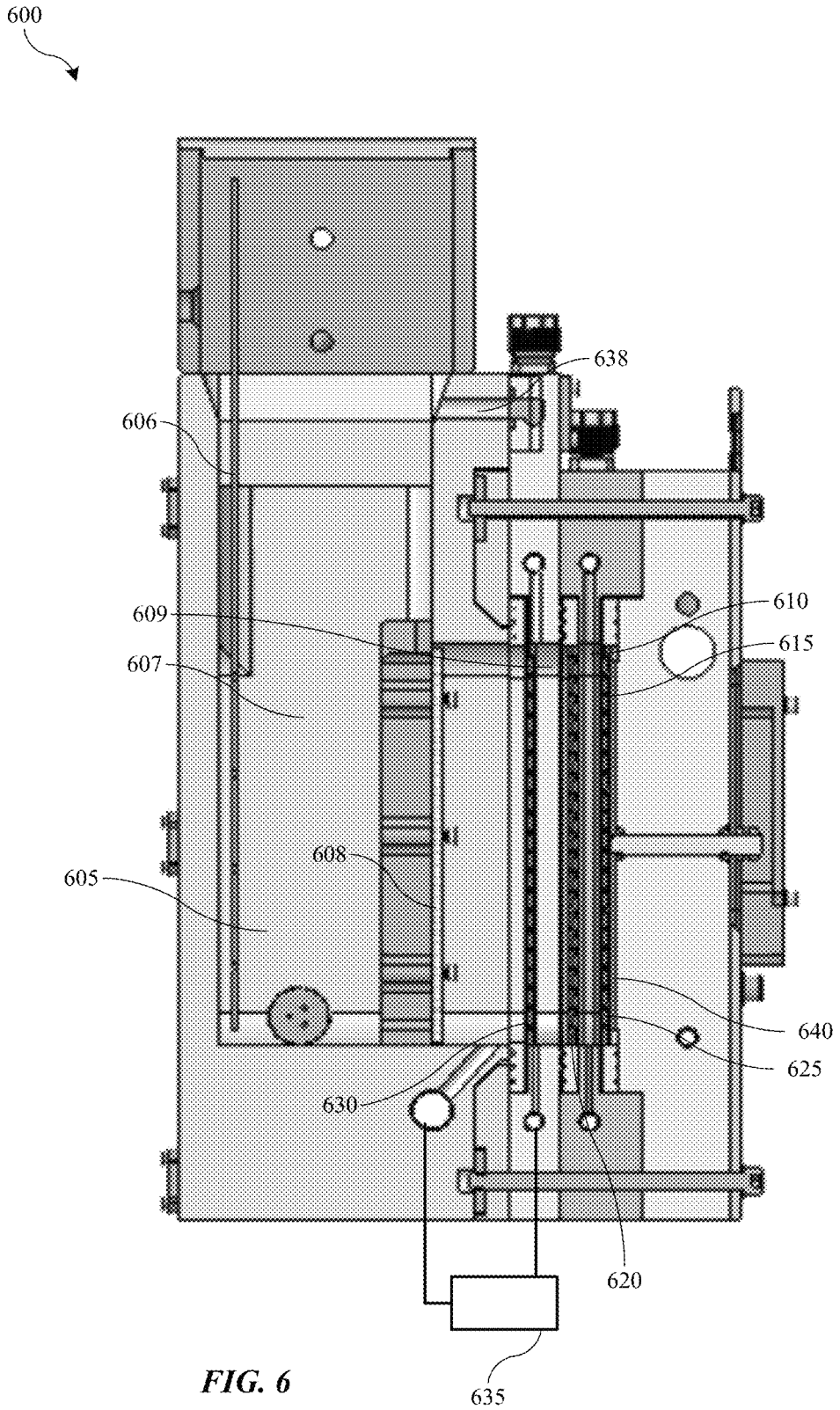
FIG. 6 shows a schematic cross-sectional view of a replenish assembly according to some embodiments of the present technology.

Turning to FIG. 6 is shown a schematic cross-sectional view of a replenish assembly 600 according to some embodiments of the present technology. Replenish assembly 600 may include any of the features, components or characteristics of replenish assembly 74, and may be incorporated in replenishing system 70 described above. Replenish system 600 may illustrate additional features of replenish assembly 74 according to some embodiments of the present technology.

Replenish assembly 600 may include a three-compartment cell including an anolyte compartment 605, or a first compartment, a catholyte compartment 610, or a second compartment, and a thiefolyte compartment 615, or a third compartment. The assembly may also include a first ionic membrane 620 between the anolyte compartment and the catholyte compartment, and may include a second ionic membrane 625 between the catholyte compartment and the thiefolyte compartment. Additionally, to overcome issues during idle state as previously described, an additional divider 630 may be included within the anolyte compartment 605, which may provide a fluid separation between a first compartment section 607 and a second compartment section 609 within the anolyte compartment. Each compartment section of the anolyte compartment may only be accessed by anolyte in a continuous loop within the anolyte compartment 605, although the additional divider 430 may facilitate operations as will be described further below.

Anolyte compartment 605 may include an electrode 606, which may be coupled with a power supply as previously described. Anode material, such as copper pellets or other metal materials used in plating, may be deposited in the cell in contact with the electrode 606. For example a retainer 608 or screen may be included to maintain anode material against the electrode and away from contacting the ionic membranes. As will be described below, a removable container may also be used to ensure the anode material is housed within the anolyte compartment and in contact with an electrode.

Divider 630 may also be an ionic membrane, which may ensure that when anolyte is flowed in each section of the anolyte compartment, the first compartment section may be electrically coupled with the second compartment section, while allowing fluid separation that may be used to fluidly isolate the compartments allowing a drain operation to occur during idle state. In some embodiments, a pump 635 or pumping system may be connected to each of the first compartment section and the second compartment sections of the anolyte compartment 605, and may be operable to pump fluid into and/or out of the second compartment section of the anolyte compartment. Anolyte may be pumped into the second compartment section 609 from the first compartment section 607, which may rise within the second compartment section and fill the second compartment section, which may be between divider 630 and first ionic membrane 620. The fluid may be pumped continuously to ensure consistency of the anolyte within the compartment sections. As fluid fills the second compartment section of anolyte compartment 605, the fluid may enter a spillway 638, which may allow the anolyte to pour back into the first compartment section 607 forming a continuous fluid loop within the anolyte compartment 605 between the two sections as will be explained further below.

Catholyte compartment 610 may be fluidly coupled with the electroplating chamber as previously described and may be filled with catholyte that may be maintained within the catholyte compartment 610 during idle states as will be described further below. The catholyte compartment 610 may be separated from the thiefolyte compartment 615 by the second ionic membrane 625, which may be a monovalent membrane in some embodiments. The thiefolyte compartment may have thiefolyte flowed within the space that may also include an inert cathode 640 electrically coupled with the power supply as previously described. Accordingly, the power supply may operate as a voltage source coupling the anode material with the inert cathode 640 through the three compartments of the chamber, which may each be electrically coupled together through the individual electrolytes and the ionic membranes.

Figure 7:
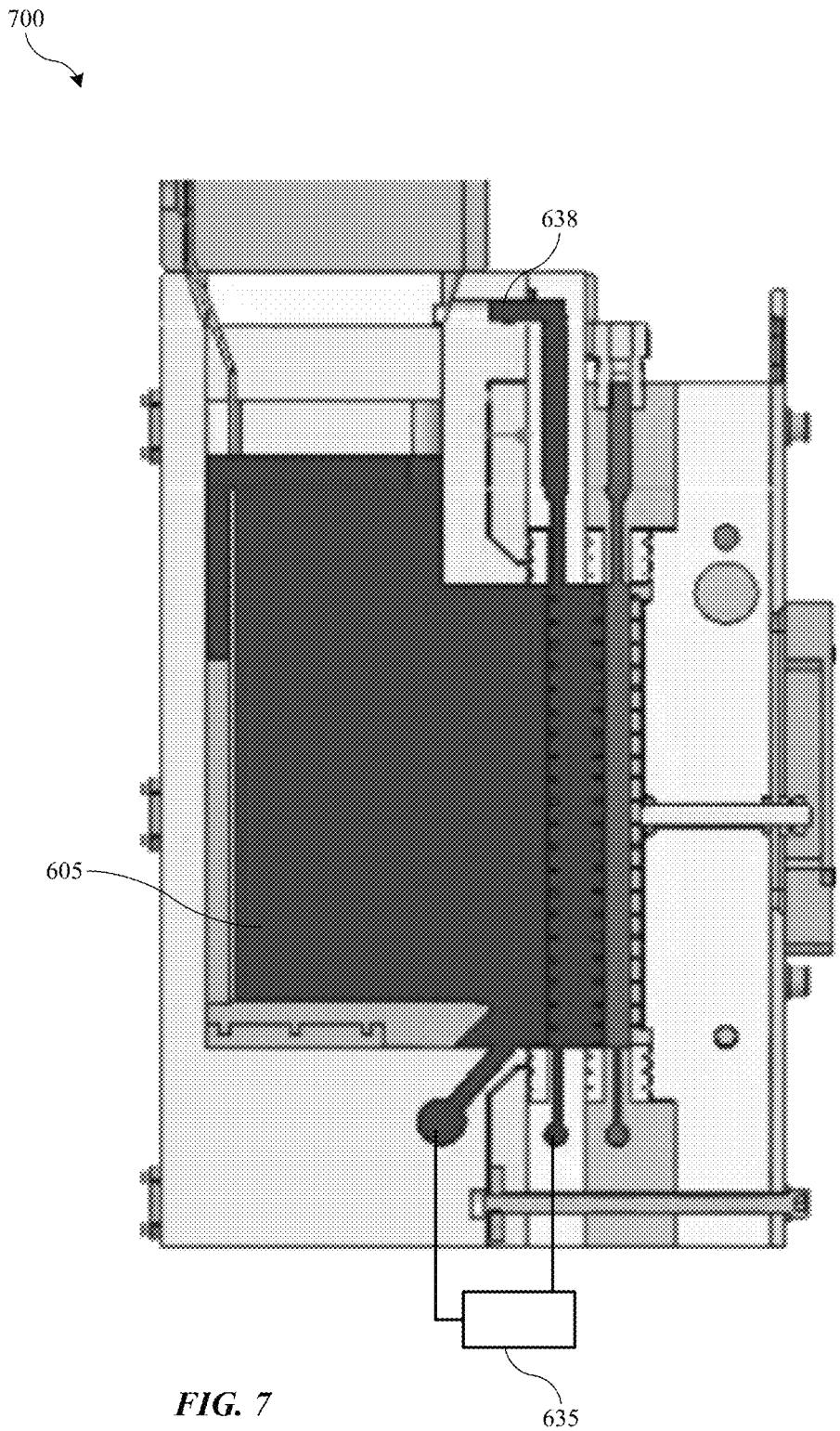
FIG. 7 shows a schematic cross-sectional view of a replenish assembly to some embodiments of the present technology.

FIG. 7 shows a schematic cross-sectional view of a replenish assembly 700 according to some embodiments of the present technology, and may illustrate replenish assembly 600 during operation. Replenish assembly 700 may include any of the components or features of systems or assemblies previously described, and may be incorporated within an electroplating system as discussed above.

As illustrated, replenish assembly 700 may include an anolyte in anolyte compartment 605, which during a first operation to replenish ions into a catholyte may be flowed through each of the first compartment section and the second compartment section of the anolyte compartment. Put another way, during a first operation for replenishing, pump 635 may be operable in a first setting to flow anolyte from the first compartment section to the second compartment section of the anolyte compartment 605. As illustrated, the anolyte may then contact the first ionic membrane adjacent the catholyte compartment, which may flow catholyte against the opposite side of the membrane. The anolyte may continue to flow up through the second compartment section of the anolyte compartment and may flow over the spillway 638 back into the first compartment section of the anolyte compartment 605. The spillway 638 may operate as a fluid path extending over the divider to produce a fluid loop that may flow continuously during operation.

Figure 8:
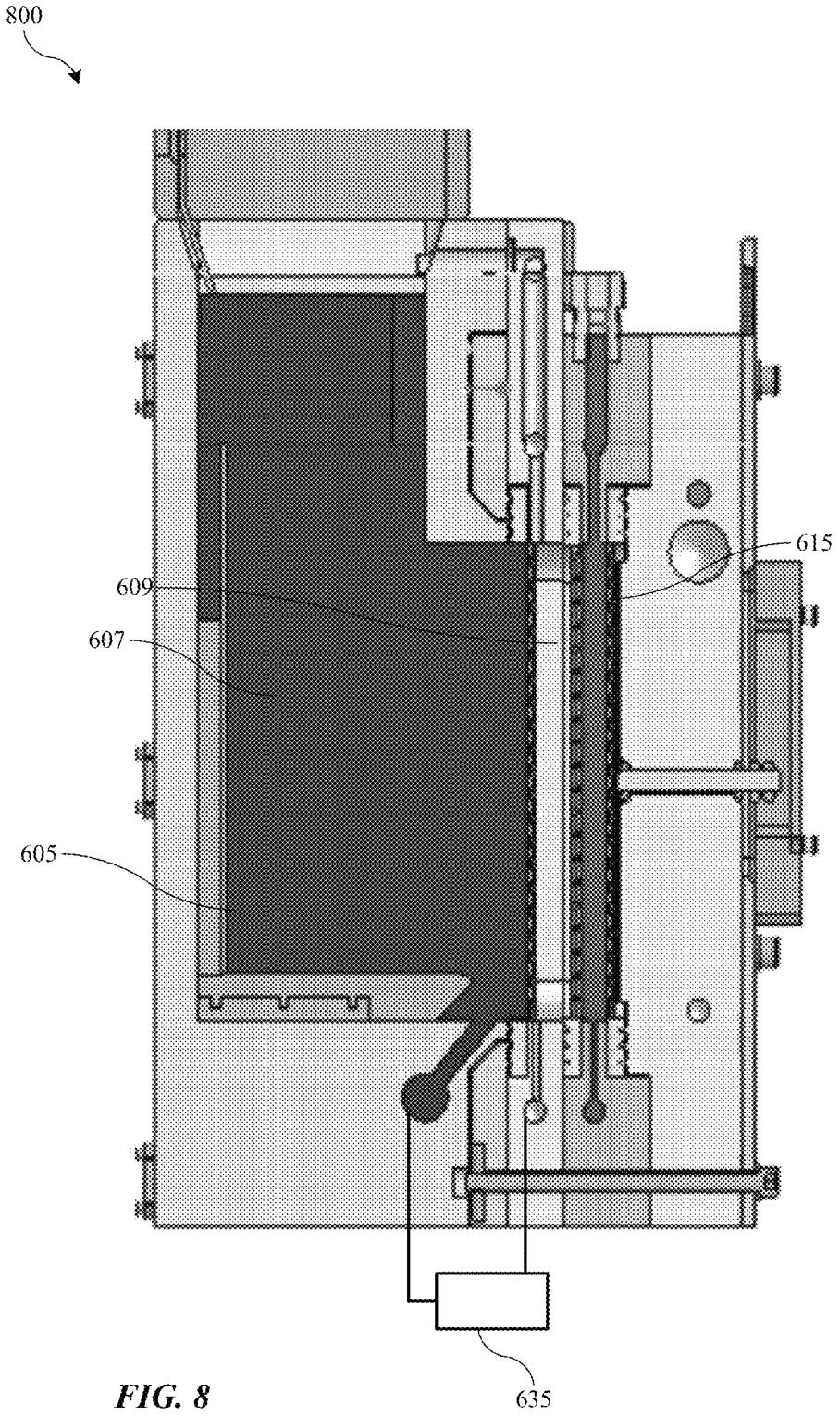
FIG. 8 shows a schematic cross-sectional view of a replenish assembly according to some embodiments of the present technology.

FIG. 8 shows a schematic cross-sectional view of a replenish assembly 800 according to some embodiments of the present technology, and may illustrate replenish assembly 600 during operation. Replenish assembly 800 may include any of the components or features of systems or assemblies previously described, and may be incorporated within an electroplating system as discussed above.

As illustrated, replenish assembly 800 may include an anolyte in anolyte compartment 605, which during a second operation of the system in ide state may be maintained within the first compartment section 607, while being drained from the second compartment section 609 of the anolyte compartment 605. Put another way, during a second operation of the system in an idle or standby state, pump 635 may be operable in a second setting, which may be a reverse from the first setting, to drain anolyte from the second compartment section 609 and pump it back to the first compartment section 607 of the anolyte compartment 605. As illustrated, first compartment section 607 may include additional headspace volume within the compartment section, which may allow the entire volume of the second compartment section 609 to be pumped back into the first compartment section 607 of the anolyte compartment.

Thiefolyte compartment 615 may similarly be drained of thiefolyte during idle state, which may prevent additional copper migration through the second ionic membrane and plating on the inert cathode. Catholyte may be retained within the catholyte compartment, which may allow the entire catholyte fluid circuit to the electroplating chamber to remain full, which may prevent air entrainment within the loop. This configuration may provide multiple benefits including maintaining all fluid separated within the replenish assembly during idle state. Additionally, each ionic membrane, which may include divider 630 as a third ionic membrane, may be maintained in contact with an electrolyte along a surface of the membrane. For example, as illustrated, the first ionic membrane may be maintained in contact with only the catholyte during idle states, and may be maintained substantially free or essentially free of anolyte, less an amount of residual anolyte that may be retained on the membrane. This may ensure the membranes do not dry out during idle time periods, which may prevent cracking and failure of the membranes. Additionally, anode materials retained in first compartment section 607 may remain fully submerged in anolyte, which may prevent oxidation. Thus, by incorporating the second compartment section of the anolyte compartment by including the additional divider within the anolyte compartment, an idle state configuration may be produced that limits or prevents migration across membranes between stagnant fluids.

Figure 9:
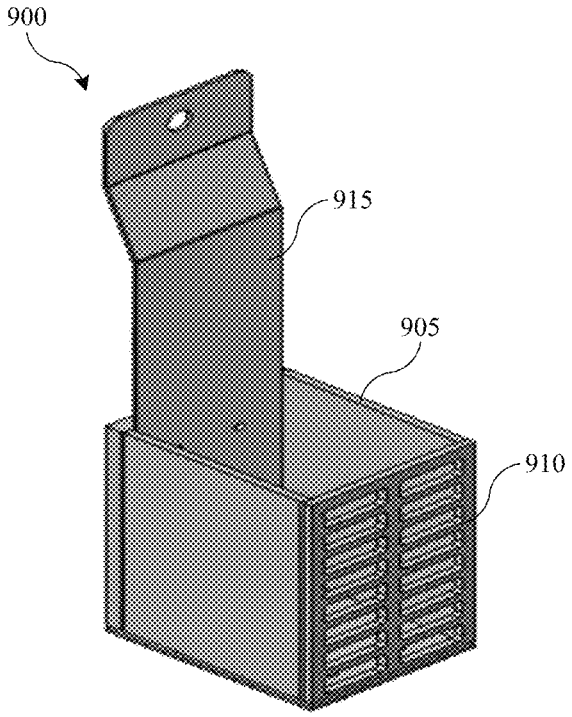
FIG. 9 shows a schematic perspective view of an anode material container according to some embodiments of the present technology.

Turning to FIG. 9 is shown a schematic perspective view of an anode material container 900 according to some embodiments of the present technology. As discussed previously, an anode material, such as copper pellets or material to replenish metal ions, may be included within the anolyte compartment, such as within the first compartment section of the anolyte compartment where anolyte may be maintained during operation and idle state. In some embodiments, a container 900 may be included that include a compartment 905 that can retain the anode materials to prevent contact with the ionic membranes, which may cause tearing or other punctures through the membrane. Compartment 905 may include a front screen 910, which may allow anolyte to flow through the compartment during operation. Additionally, electrode 915 may extend into the compartment as illustrated, which may further ensure electrical communication with the anode material. For example, the compartment 905 may be electrically conductive, which may ensure that the anode material is in electrical contact with the power supply. It is to be understood that a container 900 may be incorporated in any of the assemblies or configurations previously described.

Figure 10:
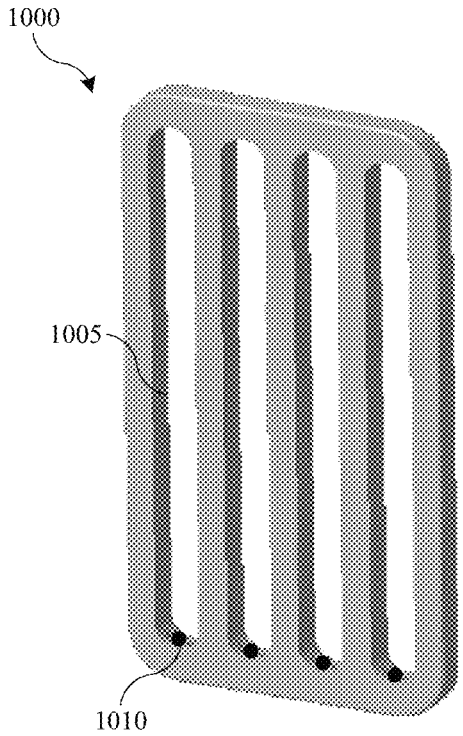
FIG. 10 shows a schematic perspective view of a cell insert according to some embodiments of the present technology.

FIG. 10 shows a schematic perspective view of a cell insert 1000 according to some embodiments of the present technology. Cell insert 1000 may be included within the catholyte compartment in some embodiments to restrict the amount of fluid flowed through the compartment at any time. During idle states, a volume of catholyte may be retained within the catholyte compartment, and which may be in contact with the first ionic membrane and the second ionic membrane. Additives may still be expressed from the catholyte onto the membranes, and which may not all reabsorb into the catholyte on restart. Accordingly, by reducing the volume of catholyte in the catholyte compartment in some embodiments, additional loss of additives may be limited or prevented.

Figure 11:
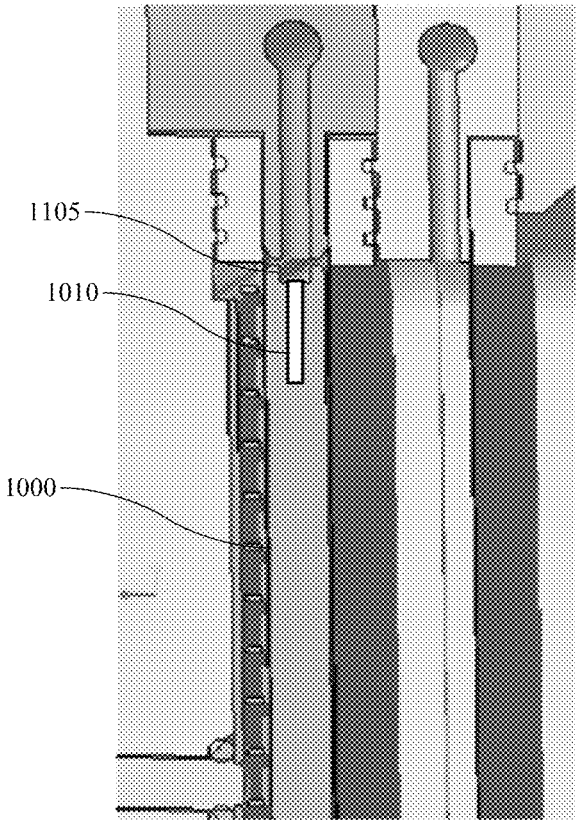
FIG. 11 shows a schematic cross-sectional partial view of a cell insert in a replenish assembly according to some embodiments of the present technology.

Cell insert 1000 may define one or more, including a plurality of fluid channels 1005 through the insert. Apertures 1010 may be formed through the two ends of the cell insert in the direction of the channels 1005 formed. FIG. 11 shows a schematic cross-sectional partial view of the cell insert 1000 in a replenish assembly according to some embodiments of the present technology, such as within a catholyte compartment as previously described. It is to be understood that cell insert 1000 may be included in any of the assemblies or configurations previously described. As illustrated, cell insert 1000 may extend laterally within the catholyte compartment to restrict the available volume for catholyte flow. In some embodiments the cell insert 1000 may contact one or both of the first ionic membrane or the second ionic membrane, although a small amount of fluid space may be maintained between the components to ensure adequate wetting of the membrane. A recessed channel 1105 may be formed within the top and bottom of the cell insert that may provide fluid access to the apertures 1010. Apertures 1010 may provide fluid from the recessed channels to the fluid channels defined vertically through the cell insert. Cell inserts according to the present technology may restrict the volume within the catholyte compartment or any other compartment by greater than or about 10%, and may restrict the volume within the compartment by greater than or about 20%, greater than or about 30%, greater than or about 40%, greater than or about 50%, greater than or about 60%, greater than or about 70%, greater than or about 80%, greater than or about 90%, or more.

The above-described systems that include conduits for transporting a portion of the anolyte to the catholyte and replenishing assemblies to maintain increased concentration of metal ion in the anolyte and catholyte are operable to conduct electroplating operations. These electroplating operations may include driving a voltage through a replenish assembly, which may include a three-compartment assembly including any of the components, features, or characteristics of assemblies or devices previously described. The assembly may include a divider within the anolyte compartment, which may be used to facilitate idle operations as previously described. The method may include providing ions of an anode material. The ions may be metal ions provided to or replenishing a catholyte flowing through a catholyte compartment of the assembly.

In some embodiments, subsequent a plating operation, the voltage may be reversed between the anode material and the cathode, which may be an inert cathode. This may allow any material that may have passed through the catholyte into a thiefolyte and plated on the inert cathode to be provided back into the plating solution and removed from the inert cathode. In some embodiments the voltage reversal operations may be performed at regular intervals. While a system may be run for an extended period of time followed by an extended voltage reversal, in some embodiments the reversal may be performed at more regular intervals for shorter periods of time. This may facilitate maintaining metal within the catholyte and may limit formation of dendrites or other defects of the anode material. For example, in some embodiments the reversal may be performed at regular intervals that may allow the reversal to be performed for a time period of less than or about 60 minutes between standard operation cycles, and may allow the reversal to be performed for less than or about 50 minutes, less than or about 40 minutes, less than or about 30 minutes, less than or about 20 minutes, less than or about 10 minutes, or less.

In some embodiments the methods may include operations to be performed prior to an idle state of the system. For example, in an optional operation, a pump may be operated to pump anolyte from a second compartment section of an anolyte compartment back into a first compartment section of the anolyte compartment where an anode material may be housed. The pumping may drain the anolyte from the second compartment section, and may remove anolyte from fluidly contacting an ionic membrane positioned between the anolyte compartment and the catholyte compartment. In some embodiments the ionic membrane may be maintained free of anolyte except for a residual amount retained within the membrane during the draining or pump out operation.

Embodiments of the present technology allow electroplating operations to be performed at increased metal ion concentrations in the catholyte over extended periods of time. The increased metal ion concentration increases the rate at which metal is deposited on a substrate during electroplating operations, increasing the throughput of substrates through the electoplating systems. In embodiments, the increase metal ion concentration is maintained for extended periods by adding a portion of the electroplating system's anolyte directly to the catholyte. The metal-ion-rich anolyte increases the concentration of metal ions in the catholyte that are being depleted by the electroplating operation. The less acidic anolyte also raises the pH in the catholyte, which further increases the transport rate of metal ions from anolyte to catholyte through ion selective membranes. The addition of a portion of the anolyte directly to the catholyte permits electroplating operations at metal ion concentrations that can exceed the metal ion concentration in a metal-ion-containing starting solution and maintain those high concentration levels even as the metal ions are being removed from the catholyte during an electroplating operation.

In the preceding description, for the purposes of explanation, numerous details have been set forth in order to provide an understanding of various embodiments of the present technology. It will be apparent to one skilled in the art, however, that certain embodiments may be practiced without some of these details, or with additional details. For example, other substrates that may benefit from the wetting techniques described may also be used with the present technology.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included. Where multiple values are provided in a list, any range encompassing or based on any of those values is similarly specifically disclosed.

As used herein and in the appended claims, the singular forms "a", "an", and "the" include plural references unless the context clearly dictates otherwise. Thus, for example, reference to "a material" includes a plurality of such materials, and reference to "the channel" includes reference to one or more channels and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. An electroplating method comprising:

adding a metal-ion-containing starting solution to a catholyte to increase a metal ion concentration in the catholyte to a first metal ion concentration;

measuring the metal ion concentration in the catholyte while metal ions electroplate onto a substrate, wherein the catholyte reaches a second metal ion concentration that is less than the first metal ion concentration;

adding a portion of an anolyte directly to the catholyte when the catholyte reaches the second metal ion concentration, wherein the addition of the portion of the anolyte increases the metal ion concentration in the catholyte to a third metal ion concentration that is greater than the first metal ion concentration;

measuring a catholyte pH in the catholyte;

detecting the catholyte pH is less than 2; and adding a second portion of the anolyte directly to the catholyte upon detecting the catholyte pH is less than 2.

2. The electroplating method of claim 1, wherein the method further comprises measuring an anolyte pH in the anolyte.

3. The electroplating method of claim 2, wherein the method further comprises adding the second portion of the anolyte directly to the catholyte upon detecting the difference between the anolyte pH and the catholyte pH is greater than 0.2.

4. The electroplating method of claim 1, wherein the third metal ion concentration in the catholyte is greater than the metal ion concentration in the metal-ion-containing starting solution.

5. The electroplating method of claim 1, wherein the second metal ion concentration in the catholyte is less than 55 g/L.

6. The electroplating method of claim 1, wherein the third metal ion concentration in the catholyte is greater than 70 g/L.

7. The electroplating method of claim 1, wherein the metal ions comprise copper ions.

8. An electroplating method comprising:

electroplating a metal on a substrate in contact with a catholyte comprising electroplatable metal ions and an acid;

measuring a catholyte pH in the catholyte and an anolyte pH in an anolyte that is separated from the catholyte by a selective ion membrane;

detecting a difference in pH between the anolyte pH and the catholyte pH is greater than 0.2; and adding a portion of the anolyte directly to the catholyte upon detecting the difference in pH between the anolyte pH and the catholyte pH is greater than 0.2.

9. The electroplating method of claim 8, wherein the method further comprises adding the portion of the anolyte directly to the catholyte upon detecting the catholyte pH is less than 2.

10. The electroplating method of claim 8, wherein the catholyte comprises an inorganic acid selected from the group consisting of sulfuric acid, hydrochloric acid, and nitric acid.

11. The electroplating method of claim 8, wherein the method further comprises adding a metal-ion-containing starting solution to the catholyte to increase a metal ion concentration in the catholyte to a first metal ion concentration;

measuring the metal ion concentration while the metal is electroplating on the substrate until the metal ion concentration reaches a second metal ion concentration that is less than the first metal ion concentration; and adding an additional portion of the anolyte directly to the catholyte upon detecting the catholyte reaches the second metal ion concentration, wherein the addition of the additional portion of the anolyte increases the metal ion concentration to a third metal ion concentration that is greater than the first metal ion concentration.

12. The electroplating method of claim 11, wherein the second metal ion concentration in the catholyte is less than 55 g/L and the third metal ion concentration in the catholyte is greater than 70 g/L.

13. The electroplating method of claim 8, wherein the metal electroplated on the substrate is selected from the group consisting of copper, tin, and nickel.

* * * * *